US005816423A

United States Patent [19]

Fenton et al.

[11] Patent Number: 5,816,423

[45] **Date of Patent: *Oct. 6, 1998**

[54] INTERMODAL CONTAINER

[75] Inventors: Gary L. Fenton, Stoughton; Gerald A. Sill, Edgerton, both of Wis.

[73] Assignee: Stoughton Trailers, Inc., Stoughton, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 569,554

[22] Filed: Dec. 8, 1995

Related U.S. Application Data

[63] Continuation of Ser. No. 142,580, Oct. 25, 1993, abandoned.

[51] Int. Cl.[6] ..... B65D 10/00

[52] U.S. Cl. ..... 220/1.5

[58] Field of Search ..... 220/1.5, 54, 77, 220/84; 410/54, 77, 84

[56] References Cited

U.S. PATENT DOCUMENTS

| | | | |
|---|---|---|---|
| 3,128,897 | 4/1964 | Wilkins | 220/1.5 |
| 3,456,829 | 7/1969 | Glassmeyer | 220/1.5 |
| 3,480,174 | 11/1969 | Sherwood | 220/1.5 |
| 3,691,595 | 9/1972 | Backteman et al. | 24/81 E |
| 3,776,169 | 12/1973 | Strecker | 114/72 |
| 3,801,177 | 4/1974 | Fylling et al. | 312/351 |
| 4,277,212 | 7/1981 | Rosaia | 410/78 |
| 4,626,155 | 12/1986 | Hlinksy et al. | 410/82 |
| 4,759,294 | 7/1988 | Schuller et al. | 105/355 |
| 4,844,672 | 7/1989 | Yurgevich | 220/1.5 X |
| 4,848,619 | 7/1989 | Corompt | 220/1.5 |
| 5,072,845 | 12/1991 | Grogan | 220/1.5 |
| 5,178,292 | 1/1993 | Korzeniowski | 220/1.5 |
| 5,255,806 | 10/1993 | Korzeniowski et al. | 220/1.5 |
| 5,265,748 | 11/1993 | Furukawa | 220/1.5 |

FOREIGN PATENT DOCUMENTS 269 594 7/1989 German Dem. Rep. .

*Primary Examiner*—Steven M. Pollard
*Attorney, Agent, or Firm*—Michael Best & Friedrich LLP

[57] ABSTRACT

An intermodal container having a nonstandard length and a plurality of lock-receiving fittings for interconnecting the container to other intermodal containers or to a support surface. The container also includes stacking points for supporting the weight of one or more other containers stacked thereon. The fittings and the stacking points are laid out on the container so that it is interfaceable with a wide variety of standard length intermodal containers.

18 Claims, 3 Drawing Sheets

INTERMODAL CONTAINER

This is a continuation of application Ser. No. 08/142,580, filed Oct. 25, 1993 entitled "INTERMODAL CONTAINER", now abandoned.

BACKGROUND OF THE INVENTION

1. Field of the Invention

The invention relates generally to intermodal containers, and more particularly to the arrangement of lock-receiving fittings and stacking points on intermodal containers.

2. Reference to Prior Art

Intermodal shipping containers are widely used in the freight hauling industry where different modes of transport (e.g., sea, rail and roadway) are used to ship the containers from one point to another. Such containers come in a variety of standard sizes including, for example, ISO (International Standards Organization) containers of 20', 24' and 40' lengths and domestic containers of 45', 48' and 53' lengths.

To secure individual containers to container transports such as ships, rail cars and trailer chassis, as well as to other intermodal containers, ISO and domestic containers are provided with lock-receiving fittings at standard locations. For example, standard 20' and 40' ISO containers have fittings located at each of their eight corners, and domestic containers are often provided with fittings located to match the fitting layout of the 20' and 40' ISO containers. In those cases where it is necessary to position fittings intermediate the opposite ends of the container, it is known to employ intermediate stacking frames including a pair of vertical stacking posts interconnected by horizontal crossmembers. Fittings are positioned at the four corners of the intermediate stacking frame.

It is also known to produce nonstandard 28' intermodal containers. The Assignee of the present invention, Stoughton Trailers, Inc. of Stoughton, Wis. (hereinafter "Assignee") is, to the best of its knowledge, the only manufacturer of 28' intermodal containers. Each of those containers includes fittings at its eight corners and an intermediate stacking frame positioned about four feet from the rear end of the container.

SUMMARY OF THE INVENTION

The invention provides an intermodal shipping container having an arrangement of lock-receiving connectors or fittings and stacking points that permit the container to interface with a variety of different standard length intermodal containers. The unique configuration of the container allows it to be incorporated into a variety of double-stack arrangements so that it can be economically transported with other containers of different sizes via standard modes of intermodal transport.

In particular, the invention provides an intermodal container configured to interface with other containers of various lengths. The intermodal container includes interconnected top, bottom, front, and opposite side walls, and a frame on which the walls are mounted. The frame includes longitudinally spaced apart front, rear, and intermediate stacking frames. The intermodal container is provided with means including a plurality of upper connectors or fittings in its top wall for interlocking another container in double-stacked relation on top of the intermodal container. Also provided is means including a plurality of lower connectors or fittings in the bottom wall for interlocking the intermodal container and a support surface (i.e., ship deck, railcar bed, trailer chassis or other container). The upper and lower fittings are positioned at the corners of the front, rear, and intermediate stacking frames, and the intermediate stacking frame is positioned to provide a unique arrangement of stacking points so that the intermodal container can be used in various double-stack arrangements. The versatility of the intermodal container is increased by providing additional lower fittings at designated locations in the bottom wall to increase the number of double-stack arrangements in which the intermodal container is capable of participating.

In one embodiment, the invention provides a nonstandard 28' intermodal container capable of being included in either the upper or lower tier of a double-stack arrangement including a standard length container(s). The nonstandard 28' intermodal container is of interest in the LTL (less than truck load) market. As part of the present invention, Assignee has redesigned and improved its aforementioned 28' intermodal container so that the new container (i.e., the container which is the subject of this invention) is capable of interfacing with a greater variety of standard length intermodal containers. The new 28' container can be transported in double-stacked relation with other containers using conventional intermodal equipment in such a manner that the space capabilities provided by that equipment are substantially fully utilized. This new 28' container is believed to satisfy the need of LTL carriers for a larger payload capacity container that is readily and economically transportable using a variety of modes of intermodal transport. This enables LTL carriers to more effectively compete in the freight transporting industry.

More particularly, in one embodiment the invention provides a 28' intermodal container having front and rear stacking frames which provide lock-receiving fittings at the eight corners of the container. The front and rear stacking frames can serve as load bearing or stacking points. The 28' container also includes an intermediate stacking frame having lock-receiving fittings at its four corners. The intermediate stacking frame is positioned approximately twenty feet from either the front or the rear end of the container. With the intermediate stacking frame so positioned, the fitting arrangement provided by the container matches the standard fitting arrangement of smaller standard containers (e.g., 20' ISO containers) so that the 28' container can be stacked with those standard containers.

Also, with the intermediate stacking frame positioned as described above, two of the 28' containers can be oriented in end-to-end relation so that the lock-receiving fittings of the intermediate stacking frames of those containers match the arrangement of fittings in larger standard containers (such as 40' ISO and 45', 48' and 53' domestic containers). Thus, a larger container can be double-stacked on top of the pair of 28' containers with the intermediate stacking frames serving as the stacking points.

To permit one or more of the 28' containers to be double-stacked on top of a larger standard container, an additional pair of lock-receiving fittings is provided in the bottom wall of the 28' container. Those additional fittings are not associated with stacking points (i.e., the front, rear or intermediate stacking frames) and are intended to interface with a stacking saddle used to double-stack two 28' containers on a longer standard container (such as 40' ISO and 45' and 48' domestic containers).

Various other features and advantages of the invention will become apparent to those skilled in the art upon review of the following detailed description, claims and drawings.

Figure 2:
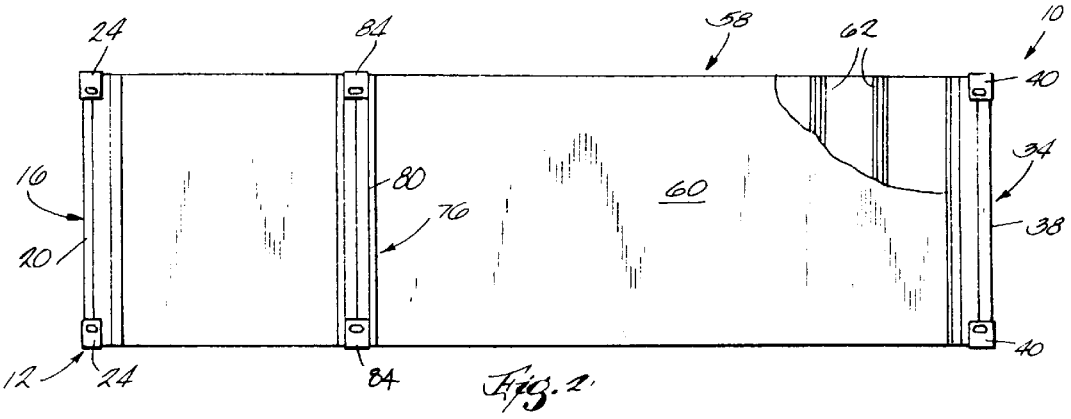
FIG. 2 is a partially cut away top plan view of the container illustrated in FIG. 1.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF A PREFERRED EMBODIMENT

Illustrated in FIGS. 1–5 is an intermodal container 10 embodying the invention. While the container 10 can be variously sized, in the embodiment illustrated in the drawings the container 10 is of nonstandard size and is about 28' long and about 8½' wide. However, one skilled in the art will recognize the application of the invention to intermodal containers of other sizes, and particularly other nonstandard container sizes. A particular application for the container 10 is in the LTL market where it can be transported over the road either alone or in tandem with another similar LTL container or trailer.

As shown in the drawings, the container 10 includes walls mounted on a frame 12, as is further explained below, to form a box-like structure defining an interior cargo receiving space. The frame 12 includes (FIG. 4) a rectangular front frame structure or stacking frame 16 having a pair of vertical front corner posts 18 interconnected by an upper crossmember 20 and a lower crossmember 22. Upper and lower lock-receiving front corner fittings 24 and 26, respectively, are provided at the four corners of the front stacking frame 16.

The frame 12 also includes (FIGS. 1 and 3) two upper rails 28 (only one of which is shown) and two lower rails 30 at the upper and lower longitudinal corners of the container 10, respectively. The upper and lower rails 28 and 30 extend between the front stacking frame 16 and a rectangular rear stacking frame 34. The rear stacking frame 34 includes (FIG. 5) a pair of vertical rear corner posts 36 interconnected by an upper crossmember 38 and a lower crossmember 39. Upper and lower lock-receiving rear corner fittings 40 and 42, respectively, are provided at the corners of the rear stacking frame 34.

To permit entry into the container 10, a set of standard swinging doors 44 (FIG. 5) is mounted on the rear stacking frame 34. As will be further explained below, a roll-up door (not shown) could be substituted for the swinging door set 44, if desired.

Figure 1:
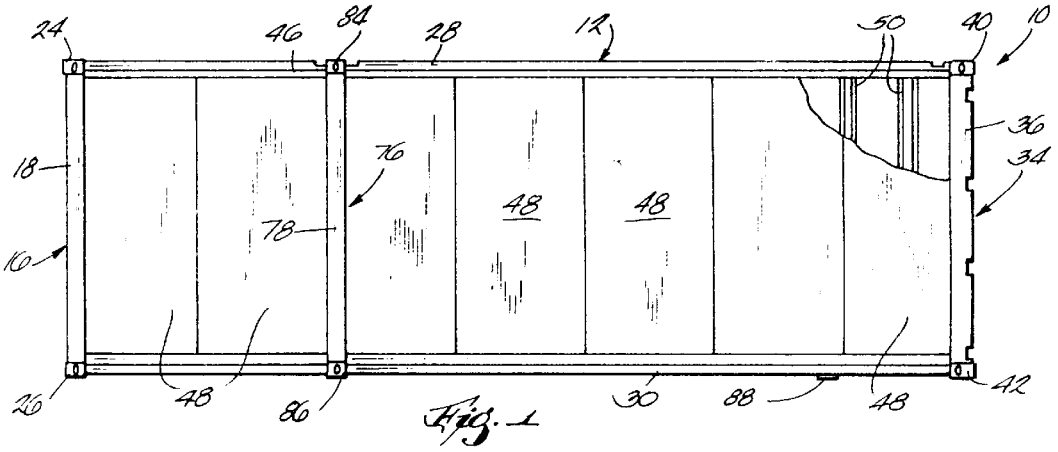
FIG. 1 is a partially cut away side elevational view of an intermodal container embodying the invention.

As shown in FIG. 1, the walls of the container 10 include a pair of opposite vertical side walls 46 (only one of which is shown). While the side walls 46 can be constructed in various ways, in the embodiment illustrated in the drawings each side wall 46 includes overlapping aluminum side skins 48 reinforced with hat-shaped interior side posts 50 that are secured between the upper rail 28 and the lower rail 30 on one side of the container 10. Suitable mechanical means such as rivets (not shown) are used to fasten the side posts 50 to the side skins 48, and plywood (not shown) can be attached to the side posts 50 to line the interior of the container 10, if desired.

Figure 4:
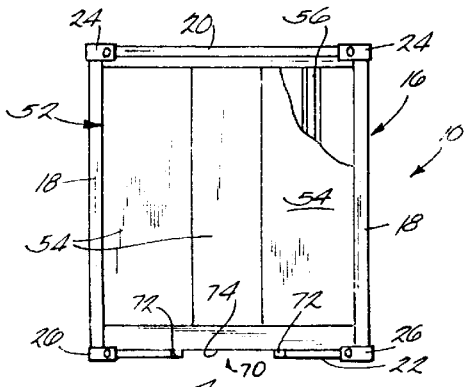
FIG. 4 is a partially cut away front view of the container illustrated in FIG. 1.
Figure 5:
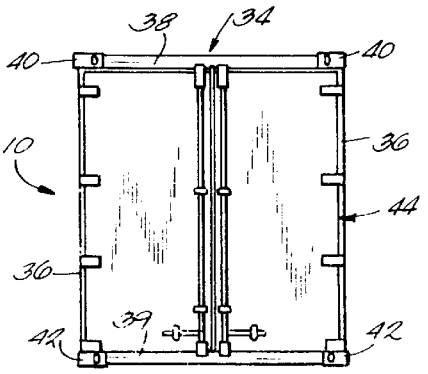
FIG. 5 is a rear view of the container illustrated in FIG. 1.

As shown in FIG. 4, a front wall 52 constructed similarly to the side walls 46 is also provided. In the illustrated embodiment the front wall 52 includes overlapping aluminum front skins 54 and hat-shaped aluminum front posts 56 (only one is shown) reinforcing the front skins 54.

The walls of the container 10 also include (FIG. 2) a top wall 58 which incorporates the upper corner fittings 24 and 40. The top wall 58 includes an aluminum roof skin 60 and spaced apart hat-shaped interior roof bows 62 for supporting the roof skin 60. The roof bows 62 are secured to the upper rails 28.

The walls of the container 10 also include (FIG. 3) a bottom wall 64 which incorporates the lower corner fittings 26 and 42. The bottom wall 64 includes spaced apart crossmembers 66 extending laterally between the lower rails 30 and supporting a floor 68 which can be made of longitudinally extending hardwood floor boards, for example. The bottom wall 64 also includes a goose-neck or tunnel section 70 extending rearwardly from the front of the container 10 and forming part of the frame 12. The tunnel section 70 includes opposite tunnel rails 72 that define a downwardly opening channel or tunnel 74 to accommodate a trailer chassis (not shown).

Figure 3:
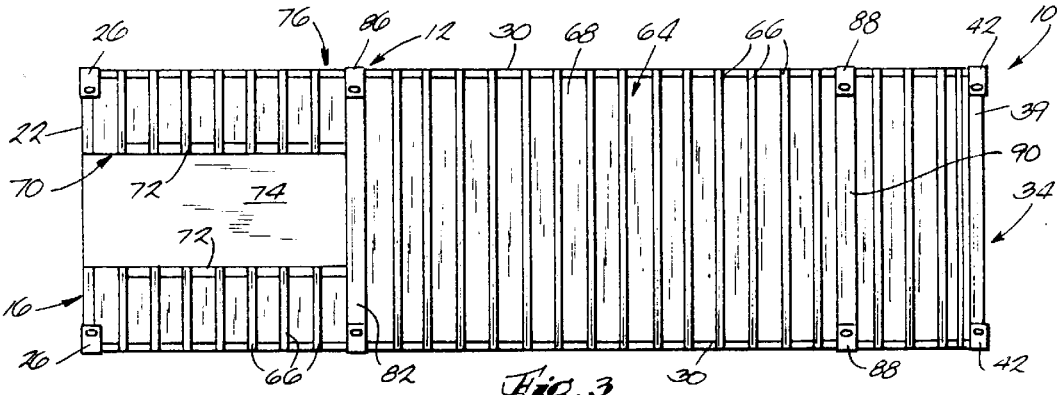
FIG. 3 is a bottom plan view of the container illustrated in FIG. 1.

The container 10 also includes means for interfacing with a variety of other containers or support surfaces having fitting layouts that normally do not match the fitting layout provided by the corner fittings 24, 26, 40 and 42. In the illustrated embodiment, the means for interfacing with other containers or surfaces includes a rectangular intermediate stacking frame 76 that forms part of the frame 12. As shown in FIGS. 1–3, the intermediate stacking frame 76 is positioned between the front and rear stacking frames 16 and 34. In the particular embodiment illustrated in the drawings, the intermediate stacking frame 76 is positioned closer to the front of the container 10 than to the rear of the container 10 and is preferably about eight feet from the front of the container 10.

Referring to FIGS. 1–3, the intermediate stacking frame 76 includes (FIG. 1) a pair of vertically extending stacking posts 78 (only one is shown) each incorporated into one of the side walls 46. The intermediate stacking frame 76 also includes (FIG. 2) an upper crossmember 80 incorporated into the top wall 58 and (FIG. 3) a lower crossmember 82. In the illustrated arrangement, the lower crossmember 82 forms a lateral rear end portion or rail of the tunnel section 70. Lock-receiving upper fittings 84 and lower fittings 86 are provided at the corners of the intermediate stacking frame 76 and are included within the top wall 58 and the bottom wall 64, respectively.

The means for interfacing with other containers and surfaces also includes (FIG. 3) a pair of additional lower fittings 88 secured to the opposite ends of a lower crossmember 90. The lower crossmember 90 is positioned forwardly (preferably a distance of about four feet) of the rear end of the container 10, and the lower crossmember 90 and the lower fittings 88 are included within the bottom wall 64. Thus, as shown in FIGS. 2 and 3, the container 10 includes six upper fittings (i.e., upper fittings 24, 40 and 84) in the top wall 58 and eight lower fittings (i.e., lower fittings 26, 42, 86 and 88) in the bottom wall 64. As will be further explained hereinafter, the lower fittings 88 are not located at a stacking frame and are therefore not associated with vertical stacking posts or an upper crossmember. This leaves sufficient room at the rear of the container 10 for the aforementioned roll-up door.

Figure 9:
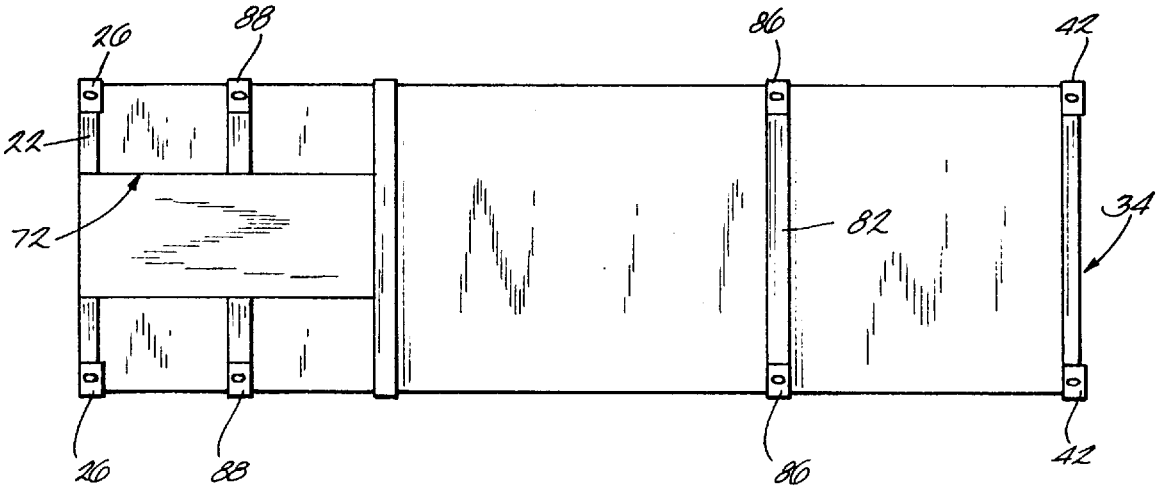
FIG. 9 is a schematic bottom plan view of a container in accordance with a second embodiment of the invention.

While in the illustrated arrangement the intermediate stacking frame 76 is closer to the front of the container 10 than to the rear and the fittings 88 are closer to the rear of the container than to the front, in another embodiment, the intermediate stacking frame 76 can be positioned closer to the rear of the container 10 than to the front and fittings 88 can be closer to the front of the container 10 than to the rear. In the latter case (which is illustrated in FIG. 9) the intermediate frame 76 will preferably be positioned about eight feet from the rear of the container.

Figure 7:
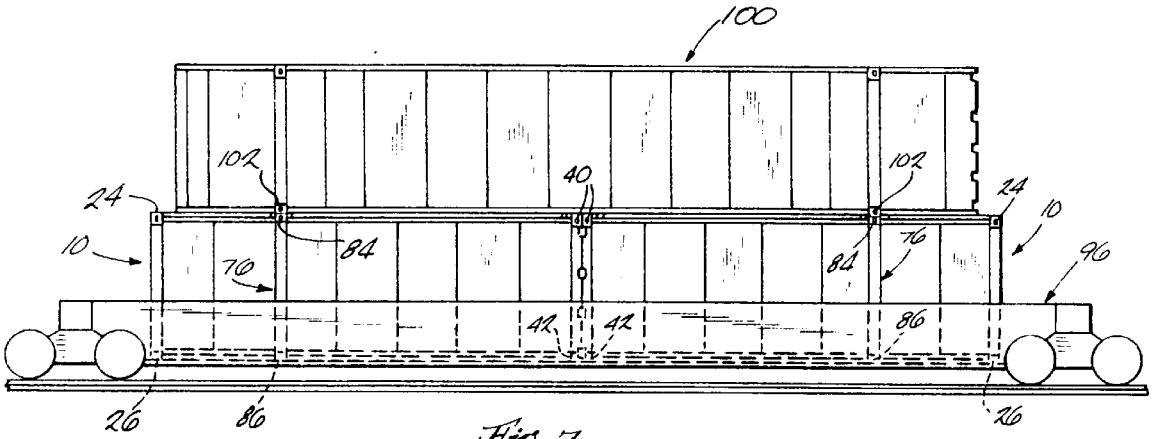
FIG. 7 is a view similar to FIG. 6, but shows a single longer container in double-stacked relation on a pair of containers.
Figure 6:
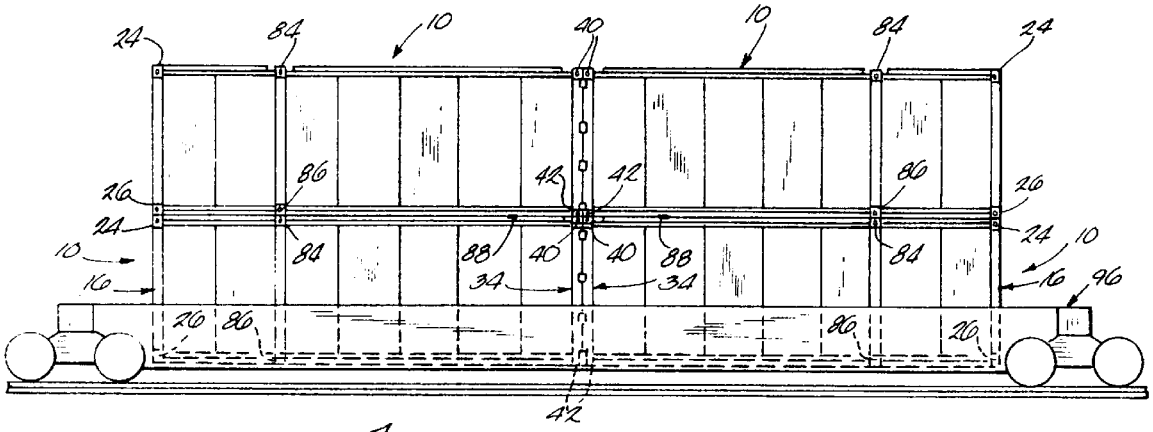
FIG. 6 is a side elevational view of four containers like the container illustrated in FIG. 1 shown in double-stacked relation in a railroad well car.
Figure 8:
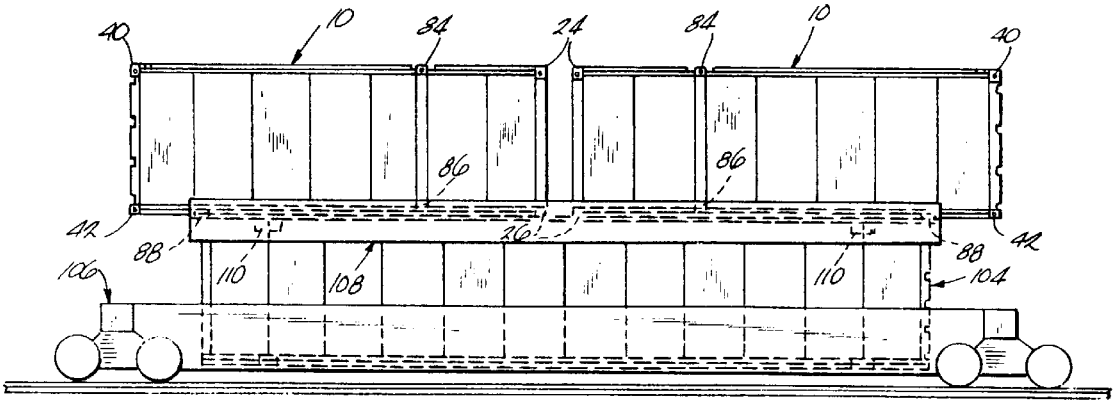
FIG. 8 is a view similar to FIG. 6, but shows a pair of containers positioned in double-stacked relation on a single longer container with the aid of a stacking frame.

Use of the container 10 in combination with other containers is illustrated in FIGS. 6–8. Illustrated in FIG. 6 is an arrangement including four of the above-described containers 10 arranged in double-stacked relation in a railroad well car 96. The well car 96 has an extra long well capable of holding two 28' containers 10 in end-to-end relation. It is preferred that the double-stacked containers 10 be arranged rear end to rear end so that access to the contents of the containers 10 through the doors 44 is denied to unauthorized persons.

As shown in FIG. 6, the layouts of the upper fittings 24 and 40 in the containers 10 in the lower tier match the layouts of lower fittings 26 and 42 in the containers 10 in the upper tier, and it is only those fittings, in conjunction with suitable locking devices (not shown), that are needed to interconnect the containers 10 in the upper and lower tiers. An example of a suitable locking device is provided in U.S. Pat. No. 4,626,155 issued Dec. 2, 1986 to Hlinsky et al. In the arrangement of FIG. 6, the front and rear stacking frames 16 and 34 of the containers 10 in the lower tier serve as stacking points.

Illustrated in FIG. 7 is an arrangement similar to that in FIG. 6, except that the upper tier of containers 10 has been replaced with a single standard size longer container 100 having fittings 102 in a standard 40' layout. In that arrangement, the upper fittings 84 of the containers 10 in the lower tier combine to provide a fitting layout that matches the fitting layout on the upper container 100, and the intermediate stacking frames 76 of the containers 10 serve as stacking points. Thus, any container (such as 40', 45', 48' and 53' containers) having standard 40' fitting locations can be double-stacked on a pair of containers 10. This was not possible with prior art 28' containers in which the intermediate stacking frame was positioned approximately 24 feet from one end of the container.

Illustrated in FIG. 8 is an arrangement in which a pair of containers 10 are double-stacked on a single longer standard container 104 positioned in a standard well car 106 that is shorter than well car 96. The containers 10 are stacked on the container 104 with the aid of a stacking frame or saddle 108 that is fully described in Assignee's U.S. Pat. No. 5,183,375 which is herein incorporated by reference. The apparatus 108 includes locking members (not shown) positioned to correspond to the standard 40' layout of fittings 110 in the container 104 to lock the saddle 108 thereon. The saddle 108 also includes additional locking members (not shown) positioned to correspond to the fitting layout presented by the lower fittings 26 and 88 in the two upper containers 10 to lock those containers on the saddle 108.

Other double-stack arrangements using one or more of the containers 10 will be apparent to those skilled in the art in view of the above. In particular, the fitting layout and stacking points provided by the container 10 permit it to interface with other containers in a variety of double-stack arrangements, making it more readily and economically transportable than the prior art 28' container.

Various features of the invention are set forth in the following claims.

We claim:

1. An intermodal container comprising a frame, said frame including exactly three stacking points, said exactly three stacking points including a front stacking frame, a rear stacking frame, and an intermediate stacking frame positioned between said front and rear stacking frames, each of said front, rear and intermediate stacking frames forming one of said stacking points, each of said front, rear and intermediate stacking frames including a pair of vertical stacking posts, each of said stacking posts including upper and lower end portions, a pair of upper lock-receiving fittings each mounted on said upper end portion of one of said stacking posts, and a pair of lower lock-receiving fittings each mounted on said lower end portion of one of said stacking posts, and said frame including additional lock-receiving fittings spaced from said stacking points so as to be independent thereof, a top wall mounted on said frame, said upper lock-receiving fittings of each of said stacking points being positioned in said top wall, a bottom wall mounted on said frame, said lower lock-receiving fittings of each of said stacking points being positioned in said bottom wall, said additional lock-receiving fittings being positioned in said bottom wall so that said lock-receiving fittings positioned in said bottom wall outnumber said lock-receiving fittings positioned in said top wall, a pair of opposite side walls mounted on said frame, said side walls extending vertically between said top and bottom walls to form a box-like structure, each of said stacking posts being positioned in one of said side walls a front wall supported by said front stacking frame, and a rear wall supported by said rear stacking frame.

2. An intermodal container as set forth in claim 1 wherein said intermediate stacking frame is positioned closer to said front stacking frame than to said rear stacking frame.

3. An intermodal container as set forth in claim 1 wherein said intermediate stacking frame is positioned closer to said rear stacking frame than to said front stacking frame.

4. An intermodal container as set forth in claim 1 and further including a downwardly opening tunnel section in said bottom wall, said tunnel section extending rearwardly from said front wall, and wherein said intermediate stacking frame includes upper and lower crossmembers, said upper and lower crossmembers extending horizontally between said stacking posts of said intermediate stacking frame, said lower crossmember forming a lateral rear end portion of said tunnel section, and wherein said additional lock-receiving fittings spaced from said stacking points are positioned between said front and intermediate stacking frames.

5. An intermodal container as set forth in claim 1 wherein said intermodal container includes exactly six of said lock-receiving fittings positioned in said top wall, and exactly eight of said lock-receiving fittings positioned in said bottom wall.

6. An intermodal container configured to interface with other intermodal containers of various lengths, said intermodal container comprising a top wall, a bottom wall, a front wall, a rear wall, a pair of opposite side walls extending vertically between said top and bottom walls to form a box-like structure, a frame on which said top, bottom, and side walls are mounted, said frame including longitudinally spaced apart front and rear stacking frames, and an intermediate stacking frame positioned intermediate said front and rear stacking frames, each of said front, rear and intermediate stacking frames including a pair of upper corners, and a pair of lower corners, and each of said front, rear and intermediate stacking frames forming a stacking point, and wherein said front wall is supported on said front stacking frame and said rear wall is supported on said rear stacking frame, means for interlocking another container in stacked relation on said intermodal container, said means for interlocking the other container in stacked relation including a plurality of connectors in said top wall, each of said upper corners of said front, rear and intermediate stacking frames including one of said connectors in said top wall, and means for interlocking said intermodal container to a support surface, said means for interlocking said intermodal container to the support surface including a plurality of connectors in said bottom wall, said connectors in said bottom wall outnumbering said connectors in said top wall, each of said lower corners of each of said front, rear and intermediate stacking frames including one of said connectors in said bottom wall, and a pair of said connectors in said bottom wall are spaced from said stacking points and are independent thereof, and wherein all of said connectors are useable simultaneously to secure said intermodal container to the support surface or to secure another container on top of said intermodal container.

7. An intermodal container as set forth in claim 6 wherein said pair of said connectors in said bottom wall that are spaced from said stacking points are positioned intermediate said front stacking frame and said intermediate stacking frame.

8. An intermodal container as set forth in claim 6 wherein said intermodal container includes exactly six of said connectors in said top wall, and exactly eight of said connectors in said bottom wall.

9. An intermodal container as set forth in claim 6 wherein said frame includes exactly three of said stacking points.

10. An intermodal container comprising a frame, said frame including exactly three stacking points, and said frame including a front stacking frame, a rear stacking frame, and an intermediate stacking frame between said front and rear stacking frames, each of said front, rear and intermediate stacking frames including a pair of vertical stacking posts, each of said stacking posts including upper and lower end portions, a pair of upper lock-receiving fittings each mounted on said upper end portion of one of said stacking posts, and a pair of lower lock-receiving fittings each mounted on said lower end portion of one of said stacking posts, and said frame including additional lock-receiving fittings spaced from said stacking points so as to be independent thereof, and each of said front, rear and intermediate stacking frames, a top wall mounted on said frame. said upper lock-receiving fittings of each of said stacking points being positioned in said top wall, a bottom wall mounted on said frame, said lower lock-receiving fittings of each of said stacking points being positioned in said bottom wall, including a downwardly opening tunnel section, said tunnel section extending rearwardly from said front stacking frame, wherein said intermediate stacking frame includes a lower crossmember, said lower crossmember extending horizontally between said stacking posts of said intermediate stacking frame, and said lower crossmember forming a lateral rear end portion of said tunnel section, and wherein said additional lock-receiving fittings are positioned between said front and intermediate stacking frames, and a pair of opposite side walls mounted on said frame, said side walls extending vertically between said top and bottom walls to form a box-like structure, each of said stacking posts being positioned in one of said side walls.

11. An intermodal container as set forth in claim 1 wherein all of said lock-receiving fittings are simultaneously useable to secure said intermodal container to a support surface and to secure another container on top of said intermodal container.

12. An intermodal container comprising a frame, said frame including a plurality of stacking points, each of said stacking points including a pair of vertical stacking posts, each of said stacking posts including upper and lower end portions, a pair of upper lock-receiving fittings each mounted on said upper end portion of one of said stacking posts, and a pair of lower lock-receiving fittings each mounted on said lower end portion of one of said stacking posts, and said frame including additional lower lock-receiving fittings spaced from said stacking points so as to be independent thereof, said additional lower lock-receiving fittings being positioned between a pair of said stacking points, a top wall mounted on said frame, each of said upper lock-receiving fittings being positioned in said top wall, a bottom wall mounted on said frame, each of said lower lock-receiving being positioned in said bottom wall, and a pair of opposite side walls mounted on said frame, said side walls extending vertically between said top and bottom walls to form a box-like structure, each of said stacking posts being positioned in one of said side walls.

13. An intermodal container as set forth in claim 12 wherein said frame includes exactly three of said stacking points, wherein the frame includes a front stacking frame, a rear stacking frame, and an intermediate stacking frame between said front and rear stacking frames, each of said front, rear and intermediate stacking frames including a pair of said vertical stacking posts and forming one of said stacking points, wherein said container includes opposite longitudinally spaced front and rear ends, wherein said front stacking frame is positioned at said front end of said container, and said rear stacking frame is positioned at said rear end of said container.

14. An intermodal container as set forth in claim 13 wherein all of said upper and lower lock-receiving fittings are useable simultaneously to secure said intermodal container to a support surface and to secure another container on top of said intermodal container.

15. An intermodal container as set forth in claim 14 wherein said frame includes exactly six of said upper lock-receiving fittings, and exactly eight of said lower lock-receiving fittings, and wherein said additional lock-receiving fittings are positioned between said front and intermediate stacking frames.

16. An intermodal container as set forth in claim 12 wherein said frame includes a front stacking frame, a rear stacking frame, and an intermediate stacking frame between said front and rear stacking frames, each of said front, rear and intermediate stacking frames including a pair of said vertical stacking posts and forming one of said stacking points, wherein said bottom wail includes a downwardly opening tunnel section, said tunnel section extending rearwardly from said front stacking frame, wherein said intermediate stacking frame includes a lower crossmember, and said lower crossmember extending horizontally between said stacking posts of said intermediate stacking frame, said lower crossmember forming a lateral rear end portion of said tunnel section, and wherein said additional lower lock-receiving fittings are positioned between said front and intermediate stacking frames.

17. An intermodal container comprising a frame, said frame including exactly three stacking points, each of said stacking points including a pair of vertical stacking posts, each of said stacking posts including upper and lower end portions, a pair of upper lock-receiving fittings each mounted on said upper end portion of one of said stacking posts, and a pair of lower lock-receiving fittings each mounted on said lower end portion of one of said stacking posts, and said frame including additional lock-receiving fittings spaced from said stacking points so as to be independent thereof, a top wall mounted on said frame, said upper lock-receiving fittings of each of said stacking points being positioned in said top wall, a bottom wall mounted on said frame, said lower lock-receiving fittings of each of said stacking points being positioned in said bottom wall, and a pair of opposite side walls mounted on said frame, said side walls extending vertically between said top and bottom walls to form a box-like structure, each of said stacking posts being positioned in one of said side walls.

18. An intermodal container as set forth in claim 17 wherein said intermodal container has a non-standard length, and wherein said stacking points are positioned so that said non-standard length intermodal container can by positioned in double-stacked relation with a variety of standard length intermodal containers.

* * * * *

UNITED STATES PATENT AND TRADEMARK OFFICE

CERTIFICATE OF CORRECTION

PATENT NO. : 5,816,423

DATED : October 6, 1998

INVENTOR(S) : Gary L. Fenton, et al.

It is certified that error appears in the above-identified patent and that said Letters Patent is hereby corrected as shown below:

Claim 10, Column 8, line 9, insert --forming one of said stacking points,-- after "frames"; and Column 8, line 15, insert --bottom wall-- after first occurrence of "bottom wall,".

Claim 16, Column 9, line 23, "wail" should be --wall--.

Signed and Sealed this

Second Day of March, 1999

*Attest:*

*Attesting Officer*

Q. TODD DICKINSON

*Acting Commissioner of Patents and Trademarks*